US006273779B1

(12) United States Patent
Boulaire

(10) Patent No.: US 6,273,779 B1
(45) Date of Patent: Aug. 14, 2001

(54) ROLLING TOY

(76) Inventor: Francois Boulaire, 747 Michigan Ave., #204, Miami Beach, FL (US) 33139

( * ) Notice: Subject to any disclaimer, the term of this patent is extended or adjusted under 35 U.S.C. 154(b) by 0 days.

(21) Appl. No.: 09/560,933

(22) Filed: Apr. 30, 2000

(51) Int. Cl.[7] ..... A63H 29/08; A63H 11/08

(52) U.S. Cl. ..... 446/169; 446/324; 446/325; 446/431; 446/351

(58) Field of Search ..... 446/169, 316, 446/324, 351, 325, 431, 396, 486

(56) References Cited

U.S. PATENT DOCUMENTS

| | | | | |
|---|---|---|---|---|
| 669,498 | * | 3/1901 | Aiken . | |
| 1,155,692 | * | 10/1915 | Vie-theer . | |
| 1,214,454 | * | 1/1917 | Gowdey . | |
| 1,538,704 | * | 5/1925 | Kay . | |
| 1,672,242 | * | 6/1928 | Bennett . | |
| 2,751,707 | * | 6/1956 | Kask . | |
| 4,952,191 | * | 8/1990 | Martinez | 446/324 |
| 5,928,055 | * | 7/1999 | Gramsch | 446/324 |

* cited by examiner

*Primary Examiner*—Jacob K. Ackun, Jr.
*Assistant Examiner*—Kurt Fernstrom

(74) *Attorney, Agent, or Firm*—Michael I. Kroll

(57) ABSTRACT

A toy for amusing people of all ages by flipping along a surface. The rolling toy includes a cylindrical tube having a first sealed end and a second sealed end and a weighted ball enclosed within the cylindrical shaped tube and having a circumference smaller than a circumference of said cylindrical tube allowing said weighted ball to roll along a length of said cylindrical tube. A flexible body portion is secured to the first sealed end of the cylindrical tube and a spring extends through the body portion. The body portion able to maintain the rolling toy in an upright position with the cylindrical tube positioned atop the body portion. When the cylindrical tube is tiled, the weighted ball is caused to roll along the length of the cylindrical tube from the first end to the second end. This causes the cylindrical tube to move towards the surface, the body portion to bend as the cylindrical tube moves towards the surface and the spring to uncoil. Upon the cylindrical tube contacting the surface, the weighted ball contacts the second surface and the spring begins to recoil causing the body portion to flip over the head portion. Momentum of the body portion rotates the head portion and the body portion to return to an upright position. The spring is preferably connected between an end of the body portion opposite the cylindrical tube and the weighted ball.

15 Claims, 4 Drawing Sheets

10
12
14
16
18
20
22
24
26
28
36,38
40
42
44
46
48
50
52
54
7
8

ROLLING TOY

BACKGROUND OF THE INVENTION

1. Field of the Invention

The present invention relates generally to toys and, more specifically, to a rolling toy including of a lightweight hollow cylindrical shaped head having a moveable weighted ball therein attached to a flat flexible body including a spring extending therethrough causing the toy to complete a flip when the head falls forward.

2. Description of the Prior Art

Numerous self-righting toys have been provided in prior art. For example, U.S. Pat. No. 2,585,780 to Johnson; U.S. Pat. No. 2,942,379 to Oman et al.; U.S. Pat. No. 3,805,444 to Adickes and U.S. Pat. No. 4,411,096 to Smith all are illustrative of such prior art. While these units may be suitable for the particular purpose to which they address, they would not be as suitable for the purposes of the present invention as heretofore described.

U.S. Pat. No. 2,585,780

Issued: Feb. 12, 1952

Inventor: Keith Whitaker Johnson

A toy comprising a tube of relatively light weight. Two outwardly convex caps of substantially equal diameter and of relatively light weight closes respectively the opposite two ends of the tube and extends laterally and rearwardly therefrom. The inner surfaces of the caps and the bore of the tube form a tubular chamber. A relatively heavy ball enclosed within the tubular chamber provides a toy adapted to balance upon one of the outwardly convex caps when placed upon a level supporting surface. The tube increases in bore diameter toward at least one end from any point along its length other than the last mentioned end. When the longitudinal axis of the tube is substantially horizontal, the gradient of the lower inner surface of the tube will cause the ball to roll to and come to rest in the last mentioned end of the tube, whereby the weight of the ball will cause the toy to rise to a substantially upright position upon the outwardly convex cap at the end containing the ball.

U.S. Pat. No. 2,942,379

Issued: Jun. 28, 1960

Inventor: Richard W. Oman et al.

A toy comprising a rockable body including a base having a convexly contoured under surface. A partition carried by the base is in position for viewing from a position above the base. The partition has fixedly positioned thereon formations which are positioned relative to one another, so as to present a variable picture image when seen from different angles. A weight is located in the base in a plane which includes a line extending perpendicularly through the center of the partition and has an arcuate line of intersection with the under surface. The weight is located below the partition and in spaced lateral relation from the line extending perpendicularly to the partition to thereby locate the center of gravity of the body, so as to position the partition at an angle with respect to the vertical when the body is at rest. Rocking motion of the body relative to its position of rest will result in a change in the angle of view with respect to the formations with consequent different visual images being produced.

U.S. Pat. No. 3,805,444

Issued: Apr. 23, 1974

Inventor: Cecil F. Adickes

A toy article having a body formed in an egg-like configuration and defined by a base portion in which a weight is located. A central portion having a preselected design is formed thereon. A top portion having a downwardly extending shaft joined thereto engages the base portion for securing the body portions together in a unitary construction. The weight in the base portion cooperating with a rounded bottom wall thereof is to insure that the body will always return to an upright position regardless of exterior forces applied thereto.

U.S. Pat. No. 4,411,096

Issued: Oct. 25, 1983

Inventor: Samuel C. Smith

There is disclosed in the present application a toy in the form of a doll or statue representing a human figure, including a body and a head which is completely separable from the body. The head is contoured and balanced in such a way that when displaced downwardly from its normal at rest position atop the body, it rolls back upwardly to its normal position, seemingly in defiance of gravity. The movement of the head toward its normal position is accomplished by one or more weights embedded in the head, which provide the necessary torque to cause it to move upwardly to its position on the shoulders.

SUMMARY OF THE INVENTION

The present invention relates generally to toys and, more specifically, to a rolling toy including a lightweight hollow cylindrical shaped head having a moveable weighted ball therein attached to a flat flexible body including a spring extending therethrough causing the toy to complete a flip when the head falls forward.

A primary object of the present invention is to provide a rolling toy that will overcome the shortcomings of the prior art devices.

Another object of the present invention is to provide a rolling toy able to flip a body section thereof in the manner of a summersault when the head portion is caused to fall forward.

A further object of the present invention is to provide a rolling toy including a lightweight hollow cylindrical shaped head having a moveable weighted ball therein whereby, when the head is allowed to fall forward, movement of the weighted ball therein causes the body to tumble over.

An even further object of the present invention is to provide a rolling toy including a spring extending through the body thereby aiding the body in flipping over when uncoiled by the falling over of the head.

A still further object of the present invention is to provide a rolling toy whereby the body is caused to do a back flip when the head is caused to fall backwards.

An even further object of the present invention is to provide a rolling toy able to entertain both children and adults.

A yet further object of the present invention is to provide a rolling toy that is simple and easy to use.

A still further object of the present invention is to provide a rolling toy that is economical in cost to manufacture.

Further objects of the invention will appear as the description proceeds.

A toy for amusing people of all ages by flipping along a surface is disclosed by the present invention. The rolling toy includes a cylindrical tube having a first sealed end and a second sealed end and a weighted ball enclosed within the cylindrical shaped tube and having a circumference smaller than a circumference of said cylindrical tube allowing said weighted ball to roll along a length of said cylindrical tube. A flexible body portion is secured to the first sealed end of the cylindrical tube and a spring extends through the body portion. The body portion able to maintain the rolling toy in an upright position with the cylindrical tube positioned atop the body portion. When the cylindrical tube is tiled, the weighted ball is caused to roll along the length of the cylindrical tube from the first end to the second end. This causes the cylindrical tube to move towards the surface, the body portion to bend as the cylindrical tube moves towards the surface and the spring to uncoil. Upon the cylindrical tube contacting the surface, the weighted ball contacts the second surface and the spring begins to recoil causing the body portion to flip over the head portion. Momentum of the body portion rotates the head portion and the body portion to return to an upright position. The spring is preferably connected between an end of the body portion opposite the cylindrical tube and the weighted ball.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DESCRIPTION OF THE REFERENCED NUMERALS

Figure 1:
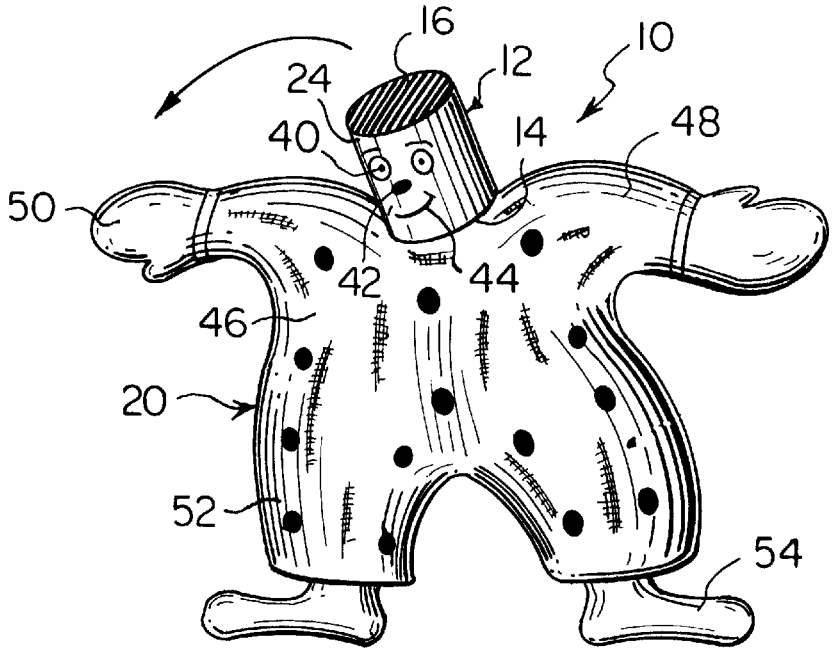
FIG. 1 is a front perspective view of the rolling toy of the present invention in a first upright position.

Turning now descriptively to the drawings, in which similar reference characters denote similar elements throughout the several views, the Figures illustrate the rolling toy of the present invention. With regard to the reference numerals used, the following numbering is used throughout the various drawing figures.

10 rolling toy
12 lightweight hollow cylindrical shaped head of rolling toy
14 first sealed end of head
16 second sealed end of head
18 weighted ball in head
20 flat flexible body of rolling toy
22 inclined surface
24 elongate tube for head
26 circumference of the weighted ball
28 inner circumference of the cylindrical tube
30 spring
32 crotch or base area of body portion
34 arrow indicating forward tilting movement of head portion
36 arrow indicating flipping movement of body portion over head portion
38 arrow indicating movement of body portion completing flip
40 simulated eye on head
42 simulated nose on head
44 simulated mouth on head
46 simulated torso on flat flexible body
48 simulated arm on flat flexible body
50 simulated hand on simulated arm
52 simulated leg on flat flexible body
54 dome shaped rounded crown on second sealed end of head
56 arrow indicating beginning of movement of head portion into upright position
58 arrow indicating movement of rolling toy back into upright position
60 rounded crown on top side of head portion

DETAILED DESCRIPTION OF THE PREFERRED EMBODIMENT

Turning now descriptively to the drawings, in which similar reference characters denote similar elements throughout the several views, FIGS. 1 through 9 illustrate the rolling toy of the present invention indicated generally by the numeral 10.

The rolling toy 10 of the present invention is illustrated in FIG. 1. The rolling toy 10 includes a substantially flat flexible body portion 20 and a head portion 12 connected to a top side of the body portion 20. The head portion 12 is preferably cylindrically shaped and hollow. The head portion 12 is also preferably closed on both ends with a bottom side sealed end 14 and a top side sealed end 16. Sealed within the head portion 12 is a weighted ball 18 as is illustrated in phantom in FIG. 2 and discussed hereinbelow with specific reference to FIGS. 7 and 8. The weighted ball 18 is of a circumference slightly less than the inner circumference of the head portion 12 and is able to roll along the length of the cylindrical head portion 12. The head portion 12 is formed of an elongate cylindrical tube 24 with the bottom side sealed end 14 closing one side thereof and the top side sealed end 16 closing the opposing side thereof. On an outer side of the cylindrical tube 24 are ornaments representative of a face for the rolling toy 10. These ornaments are for purposes of illustration only, adding to the appearance of the rolling toy, and not meant to limit the scope of the present invention. The ornaments shown include eyes 40 positioned adjacent the top of the cylindrical tube 24, a nose 42 positioned below the eyes 40 and a mouth 44 positioned below the nose 42 providing the appearance of the face for the rolling toy 10.

Figures 5, 6, 7, 8:
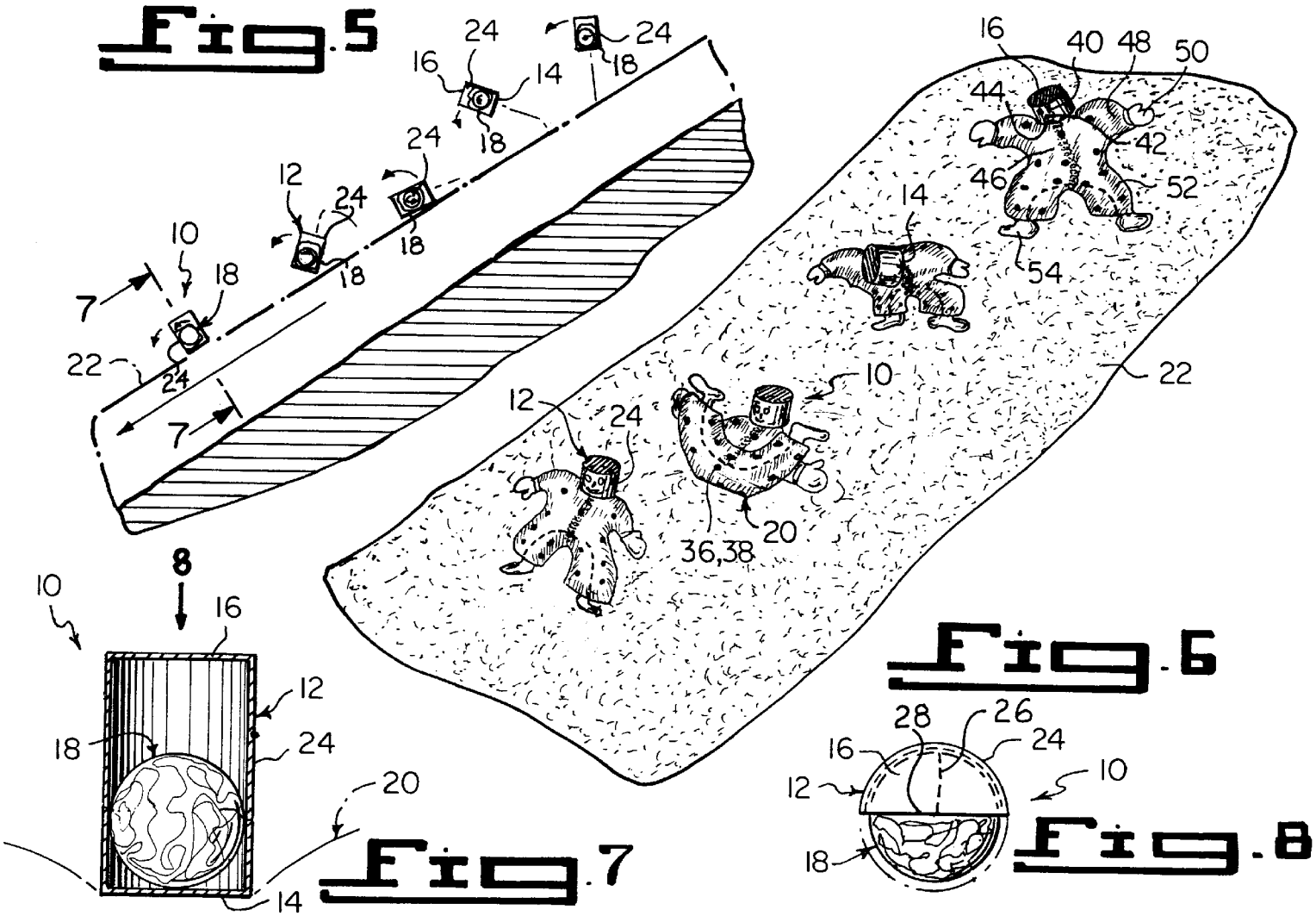
FIG. 5 is a diagrammatic side cross-sectional view of the head portion of the rolling toy of the present invention, showing positions of the ball within the head portion during tumbling of the rolling toy down an inclined surface.
FIG. 6 is a perspective view of the rolling toy of the present invention on the inclined surface, showing the various positions of the rolling toy at different points during tumbling down an inclined surface.
FIG. 7 is an enlarged cross-sectional view of the head of the rolling toy of the present invention taken along line 7—7 in FIG. 5.
FIG. 8 is a top view of the ball within the head of the rolling toy of the present invention taken in the direction of arrow 8 in FIG. 7.

An enlarged cross-sectional view of the head portion 12 is illustrated in FIG. 7. From this view it is seen that the cylindrical tube 24 forming the head portion 12 is hollow. The bottom side sealed end 14 closes off a bottom side of the cylindrical tube 24 and the top side sealed end 16 closes off a top side of the cylindrical tube 24. The cylindrical tube 24 forming the head portion 12 is preferably fabricated out of any combination of a plastic material, cardboard material or any other light weight sturdy material able to retain the weighted ball 18 therein and withstand the pressure applied by the weighted ball 18 when rolling therein and impacting the bottom and top sealed ends 14 and 16, respectively, thereof. Sealed within the cylindrical tube 24 is the weighted ball 18. The circumference of the weighted ball 18 is smaller than the inner circumference of the cylindrical tube 24 as shown in FIG. 8 thereby allowing the weighted ball 18 to roll within and along the length of the cylindrical tube 24. The weighted ball 18 is preferably fabricated out of glass, steel or plastic. However, any suitable material able to be formed into a ball and having a weight able to cause the rolling toy 10 to flip as discussed hereinbelow may be used. At the bottom side of the cylindrical tube 24, the bottom side sealed end 14 is connected to the body portion 20 of the rolling toy 10.

A top side view with parts cut away of the head portion 12 illustrated in FIG. 7 is shown in FIG. 8. This figure shows the top side sealed end 16 partially cut away to provide a view inside the cylindrical tube 24. Movably sealed within the cylindrical tube 24 is the weighted ball 18. The circumference 26 of the weighted ball 18 is shown to be slightly less than the inner circumference 28 of the inside of the cylindrical tube 24. This allows the weighted ball 18 to roll along the length of the cylindrical tube 24.

Figure 9:
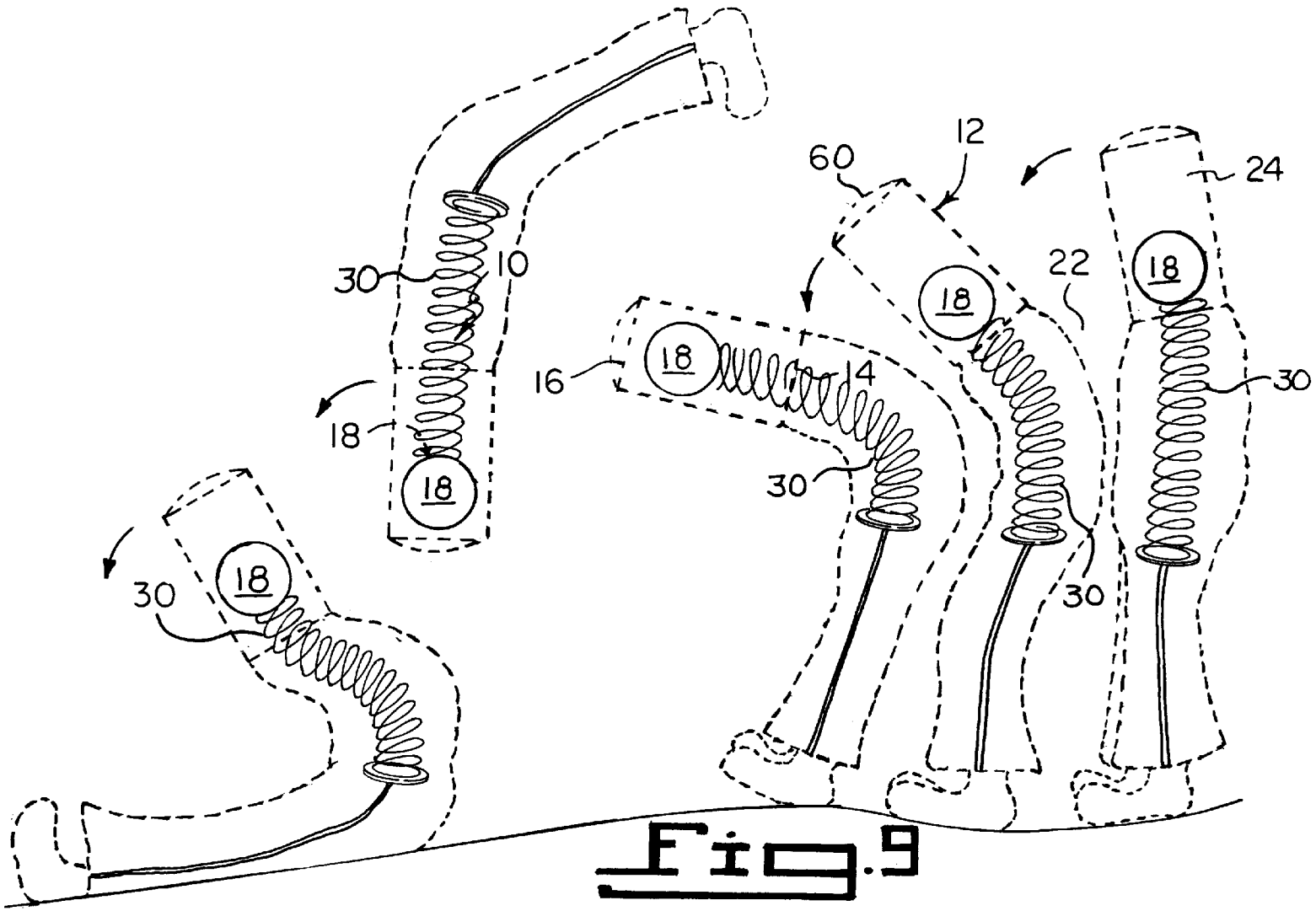
FIG. 9 is an enlarged diagrammatic side view of the rolling toy of the present invention tumbling down an inclined surface and showing various positions of the ball within the head at various points during tumbling of the rolling toy down the inclined surface.

As illustrated in FIG. 9, the lightweight hollow cylindrical shaped head 12 can contain a dome shaped rounded crown 60 on the top side sealed end 16. This dome 60 facilitates the tumbling of the rolling toy 10 down an inclined plane or even over a flat surface by decreasing the friction between the head portion and the surface on which the rolling toy 10 is flipping.

The body portion 20 is attached to the bottom side sealed end 14 of the head portion 12. An exemplary body portion 20 is illustrated in FIG. 1 and throughout the drawings. This body portion 20 is illustrated for purposes of example only and not meant to limit the scope of the present invention. The flat flexible body 20 can be fabricated out of a thin sheet of plastic material, a thin sheet of cloth material 38 or any other material which is able to retain the rolling toy 10 in an upright position maintaining the heap portion 12 thereatop while also being bendable and stretchable. The body portion 20 is preferably shaped in the form of an animated object as shown in the figures including a simulated torso 46, a pair of arms 48 with hands 50 and a pair of legs 52 with feet 54. The feet 54 should be of a dimension able to provide a stand for retaining the rolling toy in an upright position. The shape of the body portion 20 is for purposes of illustration only, adding to the appearance of the rolling toy, and not meant to limit, the scope of the present invention. Positioned within the body portion 20 and shown in FIGS. 2–4 and 9 is a spring 30. The spring 30 is connected between the bottom sealed end 14 of the head portion 12 and a crotch or base area 32 of the body portion 20. When the head portion 12 is caused to lean forward and fall towards the base of the body portion 20 the spring 30 is caused to uncoil as will be explained hereinafter. The spring 30 will recoil when the head portion 12 reaches a solid surface causing the body portion 20 to move with the spring 30 and complete a flip of the rolling toy 10. The spring 30 may be secured to the weighted ball 18 and thus be caused to uncoil and recoil as the weighted ball rolls within the cylindrical tube 24.

Figure 2:
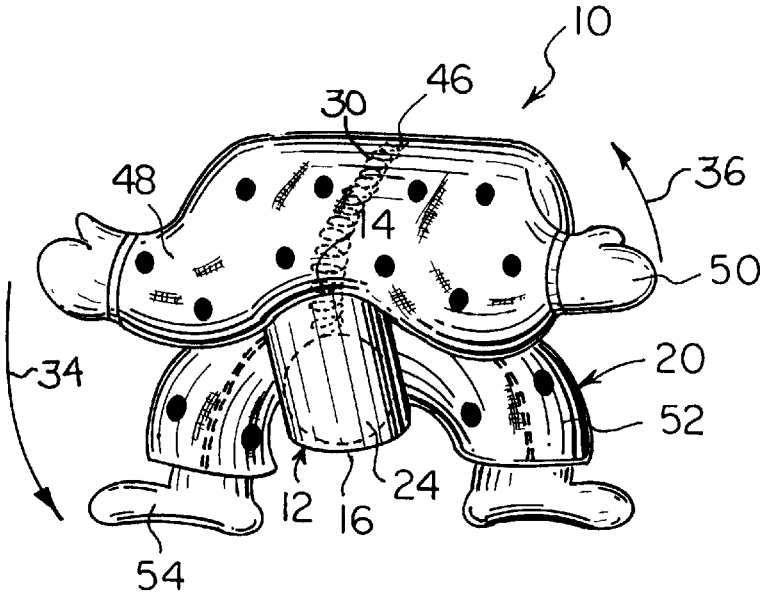
FIG. 2 is a front perspective view of the rolling toy of the present invention in a second position with the head falling forward.
Figure 3:
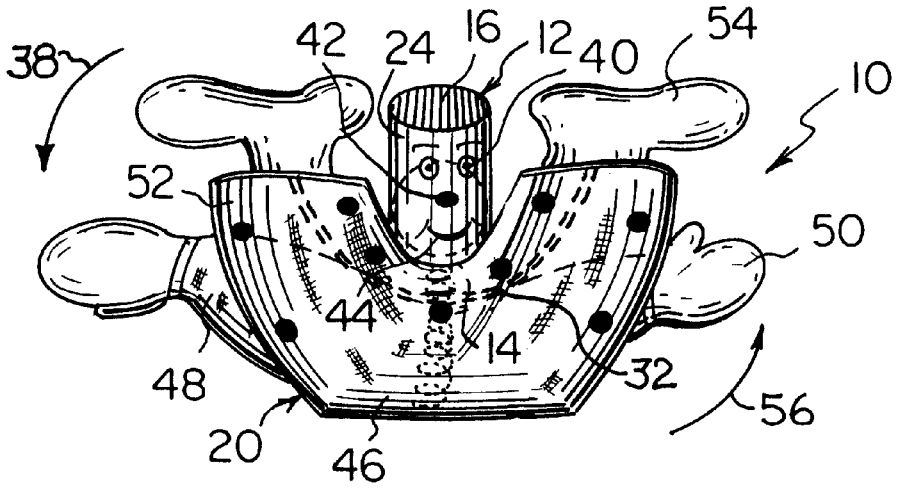
FIG. 3 is a back perspective view of the rolling toy of the present invention in a third position in which the head fell forward and the body is following mid way through a summersault.
Figure 4:
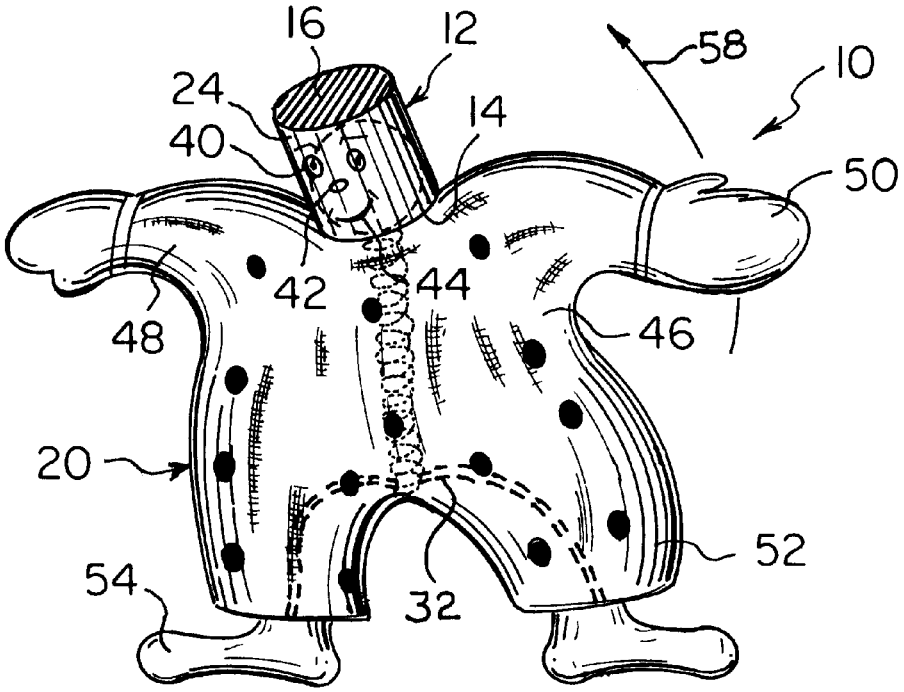
FIG. 4 is a front perspective view of the rolling toy of the present invention in a fourth position completing the summersault and returning to the original upright position.

FIGS. 2, 3 and 4 illustrate the bendable nature of the body portion 20 and the positions of the rolling toy 10 at different points during a flip thereof. FIG. 2 illustrates a first position of the rolling toy 10 during a forward flipping thereof. In this position, the head portion 12 was caused to tilt forward in the direction of the arrow labeled with the reference numeral 34. The movement of the head portion 12 in this manner causes the weighted ball 18 within the cylindrical tube 24 to roll to the top side of the cylindrical tube 24 and applies a force to both the top side sealed end 16 and the spring 30. This force causes the head portion 12 to move towards the surface on which the rolling toy 10 is positioned and the spring 30 to uncoil. Upon the head portion 12 contacting a surface on which the rolling toy 10 is positioned, the spring 30 will be at its maximum extension point. At this time the spring 30 will attempt to recoil. As the spring 30 recoils, the connection of the spring 30 to the crotch area 32 of the body portion 20 will cause the body portion 20 to flip over the top of the head portion 12 in the direction of the arrow labeled with the reference numeral 36.

FIG. 3 illustrates the position of the rolling toy 10 midway through a flip. At this point of the flip, the body portion 20 has swung over the top of the head portion 12 in the direction of the arrow labeled with the numeral 38. In this position the back side of the body portion 20 is positioned on the surface on which the rolling toy 10 is positioned and the spring has moved into a recoiled position. The legs 52 and feet 54 of the body portion 20 will continue to rotate until they contact the surface. At this point, the weighted ball 18 shown in phantom has rotated to contact the bottom side sealed end 14 at the bottom of the cylindrical tube 24. The momentum of the rolling toy 10 causes the head portion 12 to rotate as indicated by the arrow labeled with the numeral 56 to a position above the body portion 20. At this point, the body portion 20 and spring 30 are bent.

FIG. 4 illustrates the end position of the rolling toy 10 upon completion of the flip. To complete the flip, the head portion continues its rotation as indicated by the arrow labeled 58. As the head portion 12 continues to a position atop the body portion 20, the body portion 20 and spring 30 will straighten out until the rolling toy 10 reaches a completely upright position as shown in the figure.

The operation of the rolling toy 10 will now be described with reference to the figures and specifically FIGS. 5, 6 and 9. The movement of the weighted ball within the head portion will be described with specific reference to FIGS. 5 and 9 and the action of the spring will be described with specific reference to FIG. 9. In operation, the rolling toy 10 is positioned on a surface 22. The figures illustrate the surface 22 as being inclined however, the surface may be flat as well. The advantages to placing the rolling toy 10 on an inclined surface is that no additional interaction is required to cause the rolling toy 10 to begin flipping beyond placement on the surface.

The rolling toy 10 is positioned on the surface 22 in an upright position, this position is the rightmost illustration in FIGS. 5, 6 and 9. In this position, the body portion is extending perpendicular to the surface 22 and the weighted ball 18 is positioned against the bottom side sealed end 14. When the rolling toy 10 is on a slanted surface 22 or the head portion 12 is caused to tilt forward, the weighted ball 18 within the cylindrical tube 24 is caused to roll towards the top side sealed end 16 of the cylindrical tube 24. Movement of the weighted ball 18 causes the head portion to tilt further towards the surface 22 and the spring 30 to begin uncoiling. Movement of the weighted ball 18 within the cylindrical tube 24 slightly above the bottom side sealed end 14 is evident from the second illustration from the right of FIG. 5 and FIG. 9. This force causes the head portion 12 to move further towards the surface on which the rolling toy 10 is positioned and the spring 30 to begin to uncoil. As the head portion tilts further, the weighted ball is caused to slide further along the length of the cylindrical tube 24, pulling the spring 30 therewith as shown in the third illustration in FIGS. 5 and 9.

Upon the head portion 12 contacting a surface on which the rolling toy 10 is positioned, the weighted ball 18 will contact the top side sealed end 16 and the spring 30 will be at its maximum extension point. This is illustrated in the fourth illustration of FIGS. 5 and 9. The second illustration of FIG. 6 shows the rolling toy 10 in this position. At this time the spring 30 will attempt to recoil. As the spring 30 recoils, the connection of the spring 30 to the crotch area 32 of the body portion 20 will cause the body portion 20 to flip over the top of the head portion 12 in the direction of the arrow labeled with the reference numeral 36. This is shown in the fourth illustration of FIG. 9. The position of the rolling toy 10 after the body portion 20 has flipped over the head portion is shown in the third illustration of FIG. 6.

The leftmost illustration of FIGS. 5, 6 and 9 show the position of the rolling toy 10 upon completion of the flip. To complete the flip, the head portion continues its rotation as indicated by the arrow labeled 58. As the head portion 12 continues to a position atop the body portion 20, the body portion 20 and spring 30 will straighten out until the rolling toy 10 reaches a completely upright position as shown in the figure. At this point, the weighted ball 18 returns to its position contacting the bottom side sealed end 14.

From the above description it can be seen that the rolling toy of the present invention is able to overcome the shortcomings of prior art devices by providing a rolling toy which is able to flip a body section thereof in the manner of a summersault when the head is caused to fall forward in a manner that is entertaining to both children and adults. The rolling toy includes a lightweight hollow cylindrical shaped head having a moveable weighted ball therein and a spring extending through the body thereby aiding the body in flipping over when uncoiled by the falling over of the head. The rolling toy is able to cause the body section to perform a back flip when the head is caused to fall backwards. Furthermore, the rolling toy of the present invention is simple and easy to use and economical in cost to manufacture.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A rolling toy comprising:

a) a cylindrical tube having a first sealed end and a second sealed and;

b) a weighted ball enclosed within said cylindrical shaped tube and having a circumference smaller than a circumference of said cylindrical tube allowing said weighted ball to roll along a length of said cylindrical tube;

c) a flexible body portion secured to said first sealed end of said cylindrical tube; and d) a spring coupled between said body portion and said weighted ball said body portion able to maintain said rolling toy in an upright position with said cylindrical tube positioned atop said body portion, wherein tilting of said cylindrical tube causes said weighted ball to roll along the length of said cylindrical tube from said first end to said second end, said cylindrical tube to move towards the surface, said body portion to bend as said cylindrical tube moves towards a surface on which said rolling toy is positioned and the spring to uncoil, and upon said cylindrical tube contacting the surface said weighted ball contact said second end and said spring begins to recoil causing said body portion to flip over said head portion whereby momentum of the body portion rotates said head portion and said body portion to return to an upright position.

2. A rolling toy as recited in claim 1, wherein said spring is connected to an end of said body portion opposite said cylindrical tube.

3. A rolling toy as recited in claim 1, wherein said spring is connected to said weighted ball.

4. A rolling toy as recited in claim 2, wherein said spring is connected to said weighted ball.

5. A rolling toy as recited in claim 1, wherein said cylindrical tube is elongate.

6. A rolling toy as recited in claim 1, wherein said cylindrical tube is fabricated out of a plastic material.

7. A rolling toy as recited in claim 1, wherein said cylindrical tube is fabricated out of a cardboard material.

8. A rolling toy as recited in claim 1, wherein said weighted ball is a spherical member.

9. A rolling toy as recited in claim 1, wherein said weighted ball is fabricated out of a glass material.

10. A rolling toy as recited in claim 1, wherein said ball is fabricated out of a steel material.

11. A rolling toy as recited in claim 1, wherein said flat flexible body is fabricated out of a thin sheet of plastic material.

12. A rolling toy as recited in claim 1, wherein said body portion is fabricated out of a thin sheet of cloth material.

13. A rolling toy as recited in claim 1, wherein said cylindrical tube includes simulated eyes, a nose and mouth providing an appearance of a head.

14. A rolling toy as recited in claim 1, wherein said body portion includes a simulated torso, a pair of arms having hands and a pair of legs having feet providing an appearance of a body.

15. A rolling toy as recited in claim 1, wherein said cylindrical tube includes a dome shaped rounded crown on said second end thereof opposite said body portion for minimizing friction between said cylindrical tube and aiding said cylindrical tube and said body portion to tumble down the inclined surface.

* * * * *